US010450993B2

(12) United States Patent
Kitazume et al.

(10) Patent No.: US 10,450,993 B2
(45) Date of Patent: Oct. 22, 2019

(54) FUEL INJECTION CONTROL DEVICE AND METHOD FOR INTERNAL COMBUSTION ENGINE

(71) Applicant: TOYOTA JIDOSHA KABUSHIKI KAISHA, Toyota-shi, Aichi-ken (JP)

(72) Inventors: Akinori Kitazume, Nagoya (JP); Masanao Idogawa, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 43 days.

(21) Appl. No.: 15/884,689

(22) Filed: Jan. 31, 2018

(65) Prior Publication Data

US 2018/0230929 A1 Aug. 16, 2018

(30) Foreign Application Priority Data

Feb. 14, 2017 (JP) ..... 2017-025465

(51) Int. Cl.
*F02D 41/30* (2006.01)
*F02D 41/04* (2006.01)
*F02D 41/06* (2006.01)

(52) U.S. Cl.
CPC ..... *F02D 41/3094* (2013.01); *F02D 41/047* (2013.01); *F02D 41/068* (2013.01); *F02D 2200/021* (2013.01); *F02D 2200/04* (2013.01); *F02D 2200/101* (2013.01)

(58) Field of Classification Search
CPC .. F02D 41/3094; F02D 41/068; F02D 41/047; F02D 2200/021; F02D 2200/101; F02D 2200/04
USPC ..... 123/435, 436, 491, 431, 299, 300; 701/103, 113, 110
See application file for complete search history.

(56) References Cited

U.S. PATENT DOCUMENTS

2009/0082937 A1 3/2009 Hokuto et al.

FOREIGN PATENT DOCUMENTS

| | | | |
|---|---|---|---|
| JP | 2005-330833 | A | 12/2005 |
| JP | 2006-274949 | A | 10/2006 |
| JP | 2013-209935 | A | 10/2013 |
| WO | 2008/012638 | A1 | 1/2008 |
| WO | 2016/075784 | A1 | 5/2016 |

OTHER PUBLICATIONS

Jun. 27, 2018 extended Search Report issued in European Patent Application No. 18156110.1.

*Primary Examiner* — Hai H Huynh
(74) *Attorney, Agent, or Firm* — Oliff PLC

(57) ABSTRACT

A fuel injection control device is applied to an internal combustion engine that includes a port injection valve and a direct injection valve. The fuel injection control device includes a port warm-up judgment section, which judges whether the intake port has been warmed up, and an injection mode determination section, which determines the injection mode based on the engine speed and a predicted load rate. When determining the injection mode at the cold operation of the internal combustion engine, the injection mode determination section sets the range of the operation region of the internal combustion engine in which the direct-injection-only mode is selected as the injection mode to be broader in a case in which the port warm-up judgment section has judged that the port has not been warmed up than in a case in which the port warm-up judgment section has judged that the port has been warmed up.

4 Claims, 6 Drawing Sheets

FUEL INJECTION CONTROL DEVICE AND METHOD FOR INTERNAL COMBUSTION ENGINE

BACKGROUND OF THE INVENTION

The present invention relates to fuel injection control device and method for an internal combustion engine applied to an internal combustion engine that includes two types of fuel injection valves, which include a direct injection valve, which injects fuel into a cylinder, and port injection valve, which injects fuel into an intake port.

The internal combustion engine that includes the above-described two types of fuel injection valves allows the injection mode to be selected among a port-injection-only mode, in which only the port injection valve performs fuel injection, a direct-injection-only mode, in which only the direct injection valve performs fuel injection, and a distributed injection mode, in which both the fuel injection valve performs fuel injection. In the fuel injection control device disclosed in Japanese Laid-Open Patent Publication No. 2013-209935, such selection of the injection mode is performed based on the coolant temperature. More specifically, if the coolant temperature is lower than or equal to a cold temperature, the port-injection-only mode is selected as the injection mode. If the coolant temperature is in the range from the cold temperature to a warm-up completion temperature, the direct-injection-only mode is selected as the injection mode. If the coolant temperature is higher than or equal to the warm-up completion temperature, the distributed injection mode is selected as the injection mode.

The above-described cold temperature is set to the lower limit value of the coolant temperature at which poor vaporization of fuel can be kept within a permissible range. The poor vaporization of fuel is caused by adhesion of fuel to the piston and the wall surface of the cylinder when fuel is injected through the direct injection valve. That is, the above-described conventional fuel injection control device switches the injection mode from the port-injection-only mode to the direct-injection-only mode if the wall temperature of the piston and the cylinder grasped from the coolant temperature is increased to a level sufficient to keep the poor vaporization, which is caused by the adhesion of fuel, within the permissible range.

If the outside air is at an extremely low temperature, the temperature of intake air flowing through the intake port is also decreased, and the intake air cools the wall surface of the intake port. Thus, although the coolant temperature is increased, the wall temperature of the intake port may sometimes be kept low. If fuel injection by the port injection valve (port injection) is performed in such a case, adhesion of fuel to the wall surface of the intake port is increased, and the amount of fuel burned in the combustion chamber is decreased accordingly. This may possibly degrade the combustion.

SUMMARY OF THE INVENTION

Accordingly, it is an objective of the present invention to provide fuel injection control device and method for an internal combustion engine that inhibit deterioration of combustion during cold operation of the internal combustion engine.

To achieve the foregoing objective, a fuel injection control device for an internal combustion engine is provided that is configured to be applied to an internal combustion engine including two types of injection valves including a port injection valve, which injects fuel into an intake port, and a direct injection valve, which injects fuel into a cylinder. The fuel injection control device switches an injection mode between a port-injection-only mode, in which only the port injection valve of the two types of injection valves performs fuel injection, and a direct-injection-only mode, in which only the direct injection valve of the two types of injection valves performs fuel injection, A state in which a wall temperature of the intake port is higher than or equal to a predetermined wall temperature is defined as a state in which the port has been warmed up. The fuel injection control device includes a port warm-up judgment section, which is configured to judge whether the port has been warmed up, and an injection mode determination section, which is configured to determine the injection mode to be executed by the internal combustion engine based on an engine speed and an engine load. The injection mode determination section is configured such that, when determining the injection mode in a cold operation, in which a coolant temperature of the internal combustion engine is lower than or equal to a predetermined coolant temperature, the injection mode determination section sets, in an operation region of the internal combustion engine specified by the engine speed and the engine load, a range of the operation region in which the direct-injection-only mode is selected as the injection mode to be broader in a case in which the port warm-up judgment section has judged that the port has not been warmed up than in a case in which the port warm-up judgment section has judged that the port has been warmed up.

According to the fuel injection control device configured as described above, in the cold operation of the internal combustion engine, if the port warm-up judgment section has judged that the port has not warmed up, that is, if it is a port non-warmed condition, the range of the operation region in which the direct-injection-only mode is selected as the injection mode is broadened compared with a case in which it is judged that the port has been warmed up, that is, it is a port warmed-up condition.

In general, during cold operation of the internal combustion engine, poor vaporization of fuel is likely to occur when the direct injection is performed. In such a cold operation, if the port has been warmed up, performing the port injection is likely to improve the combustion rather than performing the direct injection. In contrast, if the port has not been warmed up during cold operation, performing the direct injection is likely to improve the combustion rather than performing the port injection.

In this respect, in the above-described fuel injection control device, if the port has been warmed up during cold operation, the operation region in which the port injection is performed is broadened, and if the port has not been warmed up, the operation region in which the port injection is performed is limited. This inhibits deterioration of combustion during cold operation of the internal combustion engine.

The port warm-up judgment section in the above-described fuel injection control device is configured to set a port warm-up judgment value as a value that is increased as the coolant temperature at a time when the startup of the internal combustion engine is initiated is decreased and is configured to judge that the intake port has been warmed up on condition that an accumulated value of an intake air amount or a fuel injection amount after the startup of the internal combustion engine is initiated is greater than or equal to the port warm-up judgment value. The accumulated value of the intake air amount or the fuel injection amount after the startup of the internal combustion engine is initiated correlates to the total amount of heat generated by combustion of the internal combustion engine after the startup is initiated, that is, the total amount of combustion heat received by the intake port through heat transfer. The wall temperature of the intake port when the startup of the internal combustion engine is initiated is presumed to be the same temperature as the coolant temperature when the startup is initiated (the startup coolant temperature). This means that the lower the startup coolant temperature, the greater becomes the amount of heat required to increase the wall temperature of the intake port to the above-described predetermined wall temperature at which it is judged that the port has been warmed up. For this reason, the port warm-up judgment value, which is set as a value that is increased as the startup coolant temperature becomes low, correlates to the amount of combustion heat required to warm up the port. It is, therefore, possible to judge whether the port has been warmed up based on the condition described above.

In a case of judging whether the port has been warmed up based on the presumption result of the intake port wall temperature assuming that the coolant temperature and the intake port wall temperature increase together, the fuel injection control performed in accordance with the warm-up state of the intake port is automatically interlocked with the fuel injection control performed in accordance with the warm-up state of the cylinder based on the coolant temperature. In contrast, in the judgment that uses the accumulated value of the intake air amount or the fuel injection amount after the startup of the internal combustion engine is initiated as described above, the coolant temperature when the startup of the internal combustion engine is initiated is only used to grasp the wall temperature of the intake port when the startup is initiated. The subsequent changes in the coolant temperature do not influence the judgment result. Thus, it is possible to perform the fuel injection control in accordance with the warm-up state of the intake port independent from the fuel injection control performed in accordance with the wall temperature of the cylinder based on the coolant temperature.

In general, the lower the engine speed, the higher becomes the pressure in the intake port. If the port injection is performed in this state, poor vaporization of fuel is likely to occur. Thus, if it is judged that the port has been warmed up when the engine speed is low, and the port injection is started in the operation region in which the port injection has not been performed, the possibility that the poor vaporization of fuel occurs and the combustion deteriorates is increased.

In this regard, the port warm-up judgment section in the above-described fuel injection control device is preferably configured to judge that the intake port has been warmed up on condition that the engine speed is higher than or equal to a predetermined value. In this case, the judgment as to whether the port has been warmed up is suspended until the state in which poor vaporization of fuel is likely to occur in the port injection is eliminated. This inhibits deterioration of combustion immediately after the judgment as described above.

To achieve the foregoing objective, a fuel injection control method is provided that is applied to an internal combustion engine including two types of injection valves including a port injection valve, which injects fuel into an intake port, and a direct injection valve, which injects fuel into a cylinder. The fuel injection control method includes switching an injection mode between a port-injection-only mode, in which only the port injection valve of the two types of injection valves performs fuel injection, and a direct-injection-only mode, in which only the direct injection valve of the two types of injection valves performs fuel injection. A state in which a wall temperature of the intake port is higher than or equal to a predetermined wall temperature is defined as a state in which the port has been warmed up. The fuel injection control method includes: judging whether the port has been warmed up; determining the injection mode to be executed by the internal combustion engine based on an engine speed and an engine load; and when determining the injection mode in a cold operation, in which a coolant temperature of the internal combustion engine is lower than or equal to a predetermined coolant temperature, setting, in an operation region of the internal combustion engine specified by the engine speed and the engine load, a range of the operation region in which the direct-injection-only mode is selected as the injection mode to be broader in a case in which it is judged that the port has not been warmed up than in a case in which it is judged that the port has been warmed up.

To achieve the foregoing objective, a fuel injection control device for an internal combustion engine is provided that is configured to be applied to an internal combustion engine including two types of injection valves including a port injection valve, which injects fuel into an intake port, and a direct injection valve, which injects fuel into a cylinder. The fuel injection control device includes circuitry. The circuitry is configured to switch an injection mode between a port-injection-only mode, in which only the port injection valve of the two types of injection valves performs fuel injection, and a direct-injection-only mode, in which only the direct injection valve of the two types of injection valves performs fuel injection. A state in which a wall temperature of the intake port is higher than or equal to a predetermined wall temperature is defined as a state in which the port has been warmed up. The circuitry is configured to perform: judging whether the port has been warmed up; determining the injection mode to be executed by the internal combustion engine based on an engine speed and an engine load; and when determining the injection mode in a cold operation, in which a coolant temperature of the internal combustion engine is lower than or equal to a predetermined coolant temperature, setting, in an operation region of the internal combustion engine specified by the engine speed and the engine load, a range of the operation region in which the direct-injection-only mode is selected as the injection mode to be broader in a case in which it is judged that the port has not been warmed up than in a case in which it is judged that the port has been warmed up.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A fuel injection control device and method for an internal combustion engine according to one embodiment will be described with reference to FIGS. 1 to 7.

Figure 1:
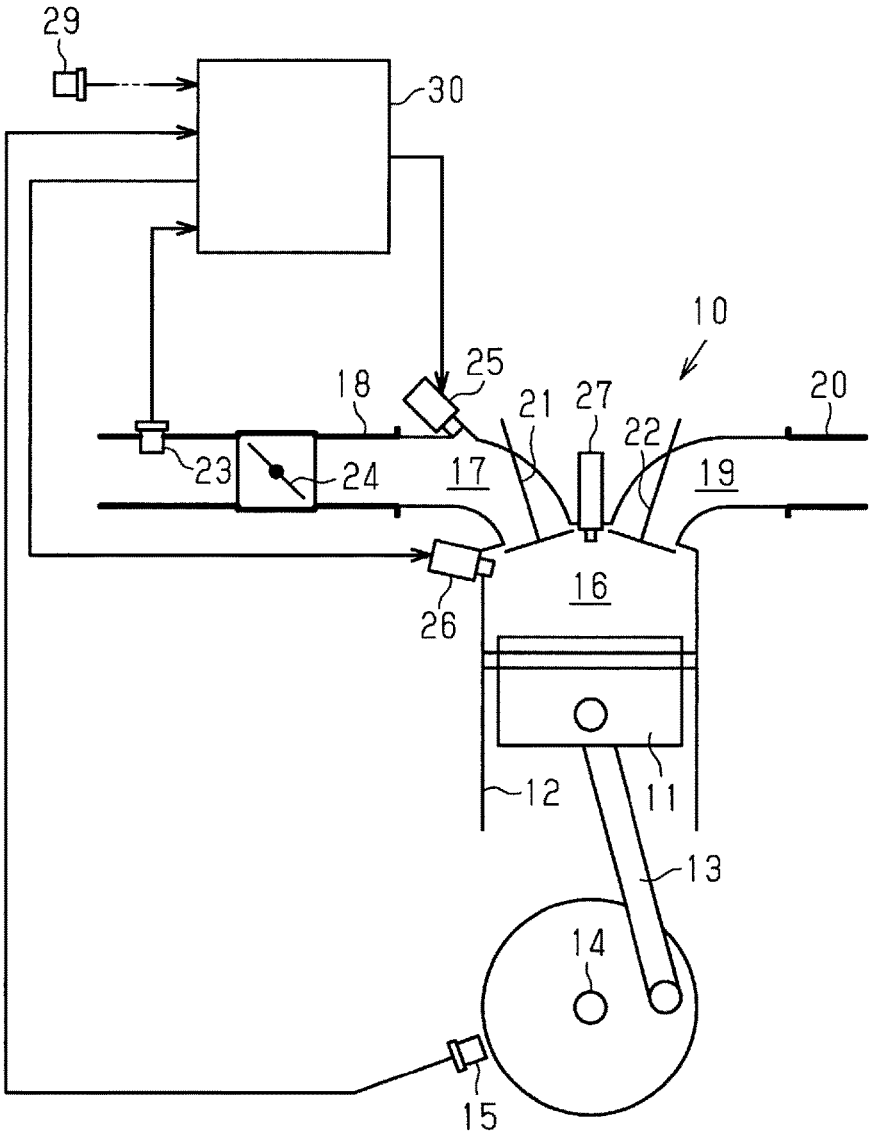
FIG. 1 is a diagram schematically illustrating the structure of an internal combustion engine to which a fuel injection control device according to one embodiment is applied.

Referring now to FIG. 1, the structure of an internal combustion engine 10 to which a fuel injection control device 30 of the present embodiment is applied will be described.

The internal combustion engine 10 includes a cylinder 12. The cylinder 12 reciprocally accommodates a piston 11. The piston 11 is coupled to a crankshaft 14 by a connecting rod 13. The coupling structure of the piston 11 functions as a crank mechanism that converts the reciprocation of the piston 11 to the rotation of the crankshaft 14. A crank angle sensor 15 is located at a section of the internal combustion engine 10 in the vicinity of the crankshaft 14. The crank angle sensor 15 outputs pulse signals (crank angle signals CR) in accordance with the rotation of the crankshaft 14.

The cylinder 12 and the piston 11 define a combustion chamber 16. An intake pipe 18 is coupled to the combustion chamber 16 by an intake port 17. An exhaust pipe 20 is coupled to the combustion chamber 16 by an exhaust port 19. An intake valve 21 is located at the joint portion between the intake port 17 and the combustion chamber 16. The intake valve 21 is selectively opened and closed in accordance with the rotation of the crankshaft 14. An exhaust valve 22 is located at the joint portion between the exhaust port 19 and the combustion chamber 16. The exhaust valve 22 is selectively opened and closed in accordance with the rotation of the crankshaft 14.

An air flowmeter 23 and a throttle valve 24 are provided in the intake pipe 18. The air flowmeter 23 detects the flow rate of intake air delivered to the combustion chamber 16 through the intake pipe 18, that is, an intake air amount GA. The throttle valve 24 is a valve that regulates the intake air amount. A port injection valve 25 is provided in the intake port 17. The port injection valve 25 performs fuel injection (port injection) to the intake air that passes through the intake port 17. Furthermore, a direct injection valve 26 and an ignition plug 27 are provided in the combustion chamber 16. The direct injection valve 26 performs fuel injection (direct injection) to the inside of the combustion chamber 16. The ignition plug 27 ignites fuel by spark discharge.

The fuel injection control device 30 of the present embodiment is configured as an electronic control unit that performs fuel injection control of the internal combustion engine 10. The fuel injection control device 30 receives the above-described crank angle signals CR and detection signals of the intake air amount GA from the air flowmeter 23. The fuel injection control device 30 also receives detection signals from a coolant temperature sensor 29. The coolant temperature sensor 29 detects the temperature of the coolant (coolant temperature THW) of the internal combustion engine 10.

The fuel injection control device 30 calculates the rotational speed (engine speed NE) of the internal combustion engine 10 based on the crank angle signals CR. The fuel injection control device 30 further calculates a predicted load rate KLFWD based on parameters such as the intake air amount GA and the engine speed NE. The predicted load rate KLFWD represents the ratio of the predicted value of the amount of intake air (cylinder inflow air amount) that flows into the combustion chamber 16 during an intake stroke to the amount of intake air at full load of the internal combustion engine 10. The fuel injection control device 30 uses the predicted load rate KLFWD as an index value of the engine load.

Figure 2:
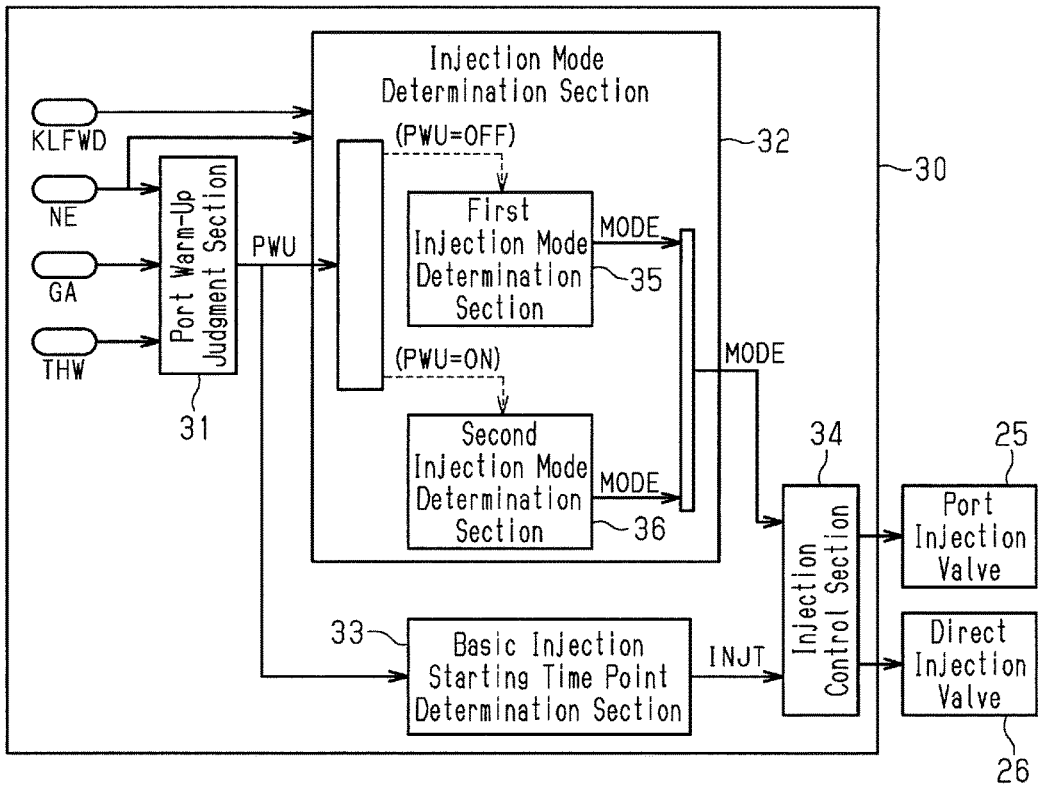
FIG. 2 is a block diagram schematically illustrating control of the fuel injection control device.

FIG. 2 illustrates the configuration of control of the fuel injection control device 30. As illustrated in FIG. 2, the fuel injection control device 30 includes a port warm-up judgment section 31, an injection mode determination section 32, a basic injection starting time point determination section 33, and an injection control section 34.

The port warm-up judgment section 31 is configured to judge whether the intake port 17 has been warmed up. The judgment result is used by the injection mode determination section 32 and the basic injection starting time point determination section 33. The details of the judgment will be discussed below.

The injection mode determination section 32 is configured to determine the injection mode executed by the internal combustion engine 10 based on the operation state (such as the engine speed NE and the predicted load rate KLFWD) of the internal combustion engine 10. In the fuel injection control device 30, the types of the injection modes are represented by a five-digit number. The five-digit number represents, in order from the upper digit, the number of times of the port injection, the number of times of the direct injection in the first half of the intake stroke, the number of times of the direct injection in the last half of the intake stroke, the number of times of the direct injection in the first half of a compression stroke, and the number of times of the direct injection in the last half of the compression stroke. The five-digit number, for example, "11000" represents that the port injection is to be performed once and the direct injection in the first half of the intake stroke is to be performed once. The five-digit number "02001" represents that the direct injection in the first half of the intake stroke is to be performed twice and the direct injection in the last half of the compression stroke is to be performed once. In the following description, the numbers representing the types of the injection mode are referred to as the injection mode MODE.

The injection mode determination section 32 determines the injection mode by calculating the value of the injection mode MODE in accordance with the operation state of the internal combustion engine 10. That is, the injection mode determined by the injection mode determination section 32 specifies the number of times of the port injection and the number of times of the direct injection in four periods including the first half of the intake stroke, the last half of the intake stroke, the first half of the compression stroke, and the last half of the compression stroke.

In the following description, the injection mode in which only the port injection valve 25 of the above-described two types of injection valves performs fuel injection, that is, the injection mode in which the number of times of the port injection is once or more and the number of times of the direct injection in the above-described four periods is zero is referred to as a port-injection-only mode. The injection mode in which only the direct injection valve 26 of the above-described two types of injection valves performs fuel injection, that is, the injection mode in which the number of times of the port injection is zero and the number of times of the direct injection in at least one of the above-described four periods is once or more is referred to as a direct-injection-only mode. Furthermore, the injection mode in which both types of injection valves perform fuel injection, that is, the injection mode in which the number of times of the port injection is once or more, and the number of times of the direct injection in at least one of the above-described four periods is once or more is referred to as a distributed injection mode.

The basic injection starting time point determination section 33 determines a basic injection starting time point INJT that is used as a reference time point at the time of calculating the injection starting time point based on the operation state of the internal combustion engine 10. The operation state of the internal combustion engine 10 includes parameters associated with the operation of the internal combustion engine 10 such as the engine speed NE and the predicted load rate KLFWD. The details of the basic injection starting time point determination section 33 will be discussed below.

The injection control section 34 controls the fuel injection of the port injection valve 25 and the direct injection valve 26 in accordance with the injection mode MODE determined by the injection mode determination section 32 and the basic injection starting time point INJT determined by the basic injection starting time point determination section 33. More specifically, the injection control section 34 first obtains the total amount of the fuel injection, which is the requested injection amount, and calculates the injection amount of each injection indicated by the value of the injection mode MODE so that the sum of these values becomes equal to the requested injection amount. Subsequently, the injection control section 34 calculates, for each injection, the injection starting time point, at which injection is started, and the injection time required for injecting fuel by the amount corresponding to the calculated injection amount. The injection control section 34 causes the port injection valve 25 or the direct injection valve 26 to perform fuel injection in such a manner that each injection to be executed starts at the calculated injection starting time point and stops when the calculated injection time has elapsed from the start.

The injection control section 34 calculates the injection starting time point of the direct injection as follows. First, the injection control section 34 calculates a value corresponding to the difference between the finally computed injection starting time point and the basic injection starting time point INJT. The injection control section 34 then obtains the sum of the calculated value and the basic injection starting time point INJT. The value obtained by performing various adjustments to the sum is calculated as the value of the injection starting time point. Thus, in principle, if the basic injection starting time point INJT is set to an earlier time point, the injection starting time point of each injection performed as the direct injection becomes early as a whole, and if the basic injection starting time point INJT is set to a later time point, the injection starting time point of each injection performed as the direct injection is delayed as a whole.

Port Warm-up Judgment

Next, the port warm-up judgment performed by the port warm-up judgment section 31 will be described in detail.

If the port injection is performed when the wall temperature of the intake port 17 (hereinafter, referred to as the port wall temperature) is at an extremely low temperature, a large amount of fuel adheres to the wall surface of the intake port 17 and the intake valve 21. Additionally, in this case, since the fuel adhered to the wall surface hardly vaporizes, a considerable part of the injected fuel does not contribute to combustion. In this respect, the port warm-up judgment section 31 determines whether the port has been warmed up. That is, if the port wall temperature becomes higher than or equal to a lower limit value of the wall temperature, it is determined that the port has been warmed up. The lower limit value is a temperature at which the deterioration of combustion caused by poor vaporization of fuel due to adhesion of fuel to the wall surface can be kept within a permissible range when the port injection is performed.

Figure 3:
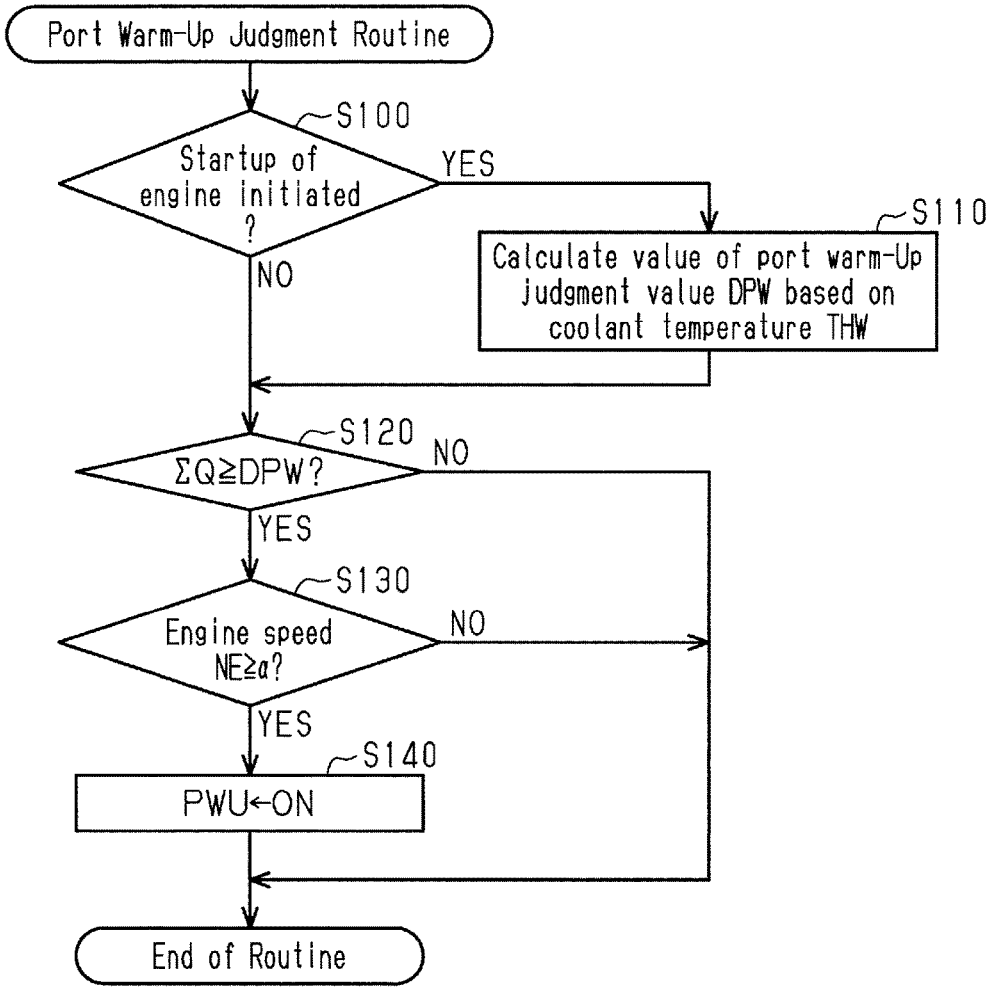
FIG. 3 is a flowchart illustrating a port warm-up judgment routine executed by the port warm-up judgment section of the fuel injection control device.

FIG. 3 illustrates a flowchart of a port warm-up judgment routine performed by the port warm-up judgment section 31. After initiating the startup of the internal combustion engine 10, the port warm-up judgment section 31 repeatedly executes this routine in a predetermined control cycle during the period until it is determined that the port has been warmed up in this routine.

When this routine is started, first, the port warm-up judgment section 31 judges whether the startup of the internal combustion engine 10 is initiated in step S100. If the startup of the internal combustion engine 10 is initiated (YES), the port warm-up judgment section 31 executes step S110 and proceeds to step S120. If the startup of the internal combustion engine 10 is not initiated (NO), the port warm-up judgment section 31 directly proceeds to step S120.

When the process proceeds to step S110, in step S110, the port warm-up judgment section 31 calculates the value of a port warm-up judgment value DPW based on the coolant temperature THW at that time. As described above, the process of step S110 is executed only once when the startup of the internal combustion engine 10 is initiated. Thus, the value of the port warm-up judgment value DPW is set in accordance with the coolant temperature THW when the startup of the internal combustion engine 10 is initiated (hereinafter, referred to as the startup coolant temperature).

When the process proceeds to step S120, in step S120, the port warm-up judgment section 31 judges whether the accumulated value of the intake air amount GA after the startup of the internal combustion engine 10 is initiated, that is, an accumulated air amount $\Sigma Q$ is greater than or equal to the port warm-up judgment value DPW. If the accumulated air amount $\Sigma Q$ is greater than or equal to the port warm-up judgment value DPW, the port warm-up judgment section 31 proceeds to step S130. If the accumulated air amount $\Sigma Q$ is less than the port warm-up judgment value DPW (NO), the current routine is terminated.

If the process proceeds to step S130, in step S130, the port warm-up judgment section 31 judges whether the engine speed NE is higher than or equal to a predetermined value $\alpha$. If the engine speed NE is higher than or equal to the predetermined value $\alpha$ (YES), the port warm-up judgment section 31 proceeds to step S140. If the engine speed NE is lower than the predetermined value $\alpha$ (NO), the current routine is terminated.

If the process proceeds to step S140, in step S140, the port warm-up judgment section 31 turns ON a port warm-up completion flag PWU and then terminates this routine. The port warm-up completion flag PWU is OFF when the startup of the internal combustion engine 10 initiated, and once it is turned ON, the port warm-up completion flag PWU is kept ON until the operation of the internal combustion engine 10 ends. Note that the port warm-up judgment section 31 executes this routine on condition that the port warm-up completion flag PWU is OFF.

According to this routine described above, after the startup of the internal combustion engine 10 is initiated, if the accumulated air amount ΣQ is greater than or equal to the port warm-up judgment value DPW, which is set in accordance with the startup coolant temperature (S120: YES), and the engine speed NE is higher than or equal to the predetermined value α, it is determined that the port has been warmed up.

Figure 4:
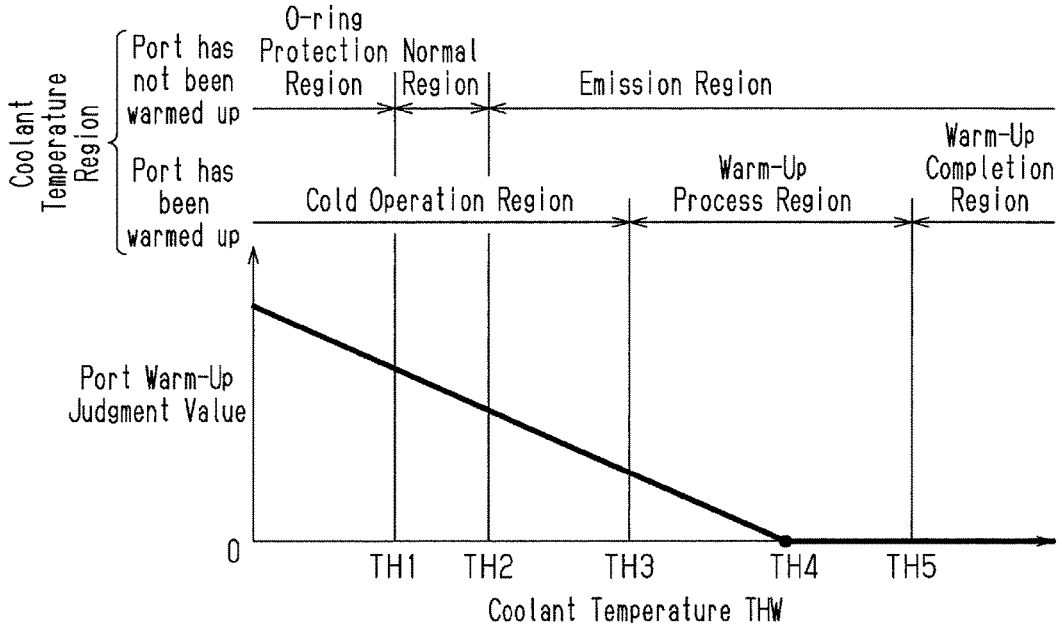
FIG. 4 is a graph illustrating the relationship between a port warm-up judgment value and a coolant temperature at startup of the engine, which are used by the port warm-up judgment section of the fuel injection control device for judging whether the port has been warmed up.

FIG. 4 illustrates the relationship between the value of the port warm-up judgment value DPW set in the above-described step S110 and the coolant temperature THW at the time of setting the port warm-up judgment value DPW, that is, the startup coolant temperature. As illustrated in FIG. 4, the lower the startup coolant temperature, the greater the port warm-up judgment value DPW is set to.

The temperature TH4 on the horizontal axis in the graph of FIG. 4 represents the temperature that serves as the lower limit value of the port wall temperature at which the deterioration of combustion caused by poor vaporization of fuel due to adhesion of fuel to the wall surface can be kept within the permissible range. That is, the state in which the port wall temperature is higher than or equal to the temperature TH4 is the state in which the port has been warmed up. The port wall temperature when the startup of the internal combustion engine 10 is initiated is considered to be substantially the same temperature as the startup coolant temperature. Thus, if the startup coolant temperature is higher than or equal to the above-described temperature TH4, the port has already been warmed up. For this reason, if the startup coolant temperature is higher than or equal to the temperature TH4, the port warm-up judgment value DPW is set to zero.

The meaning of the port warm-up judgment value DPW and the judgment of the above-described step S120 using the port warm-up judgment value DPW will now be described. If a sufficient time has elapsed from the end of the previous operation of the internal combustion engine 10 to the initiation of the current startup, the coolant temperature THW is decreased to the same temperature as the outside air. Likewise, the port wall temperature is also decreased to the same temperature as the outside air. In this embodiment, the startup coolant temperature is presumed to be the port wall temperature at the initiation of the startup of the internal combustion engine 10.

After the startup of the internal combustion engine 10 is initiated, heat generated by the combustion in the combustion chamber 16 is transmitted to the wall surface of the intake port 17. The heat generated by the combustion correlates to the amount of air in the air-fuel mixture combusted in the combustion chamber 16. Thus, after the startup of the internal combustion engine 10 is initiated, the total amount of heat received by the intake port 17 due to the transmission of the combustion heat correlates to the accumulated air amount ΣQ. If the port wall temperature at the time when the startup of the internal combustion engine 10 is initiated is assumed to be equal to the startup coolant temperature, the greater the difference between the port wall temperature (temperature TH4), at which it is determined that the port has been warmed up, and the startup coolant temperature, or the lower the startup coolant temperature, the greater becomes the accumulated air amount ΣQ required for the port wall temperature to reach the temperature TH4. Thus, the value of the port warm-up judgment value DPW is set to a value that is increased if the startup coolant temperature is low compared with a case in which the startup coolant temperature is high. It is determined whether the port has been warmed up by determining whether the accumulated air amount ΣQ is greater than or equal to the port warm-up judgment value DPW.

The judgment based on the engine speed NE in step S130 is performed for the following reason. The higher the pressure in the intake port 17, the more difficult it becomes for the fuel injected from the port injection valve 25 to vaporize. Even if the intake air amount GA is the same, the lower the engine speed NE, the higher becomes the pressure in the intake port 17. Thus, it is determined that the port has been warmed up on condition that the engine speed NE is higher than or equal to the predetermined value α so that the determination that the port has been warmed up is made only in an environment in which the injected fuel is easily vaporized if the port injection is immediately started.

Determination of Injection Mode

Next, determination of the injection mode MODE performed by the injection mode determination section 32 will be described in detail.

As illustrated in FIG. 2, the injection mode determination section 32 includes a first injection mode determination section 35 and a second injection mode determination section 36, which are the configuration for the lower-order control. The injection mode determination section 32 is configured to select one of the first injection mode determination section 35 and the second injection mode determination section 36 to use for the determination of the injection mode MODE based on whether the port warm-up judgment section 31 has judged that the port has been warmed up. More specifically, in the injection mode determination section 32, if the port warm-up completion flag PWU is OFF and it is judged that the port has not been warmed up (port non-warmed condition) by the port warm-up judgment section 31, the first injection mode determination section 35 determines the injection mode MODE. In the injection mode determination section 32, if the port warm-up completion flag PWU is ON and it is judged that the port has been warmed up by the port warm-up judgment section 31, the second injection mode determination section 36 determines the injection mode MODE.

Figure 5:
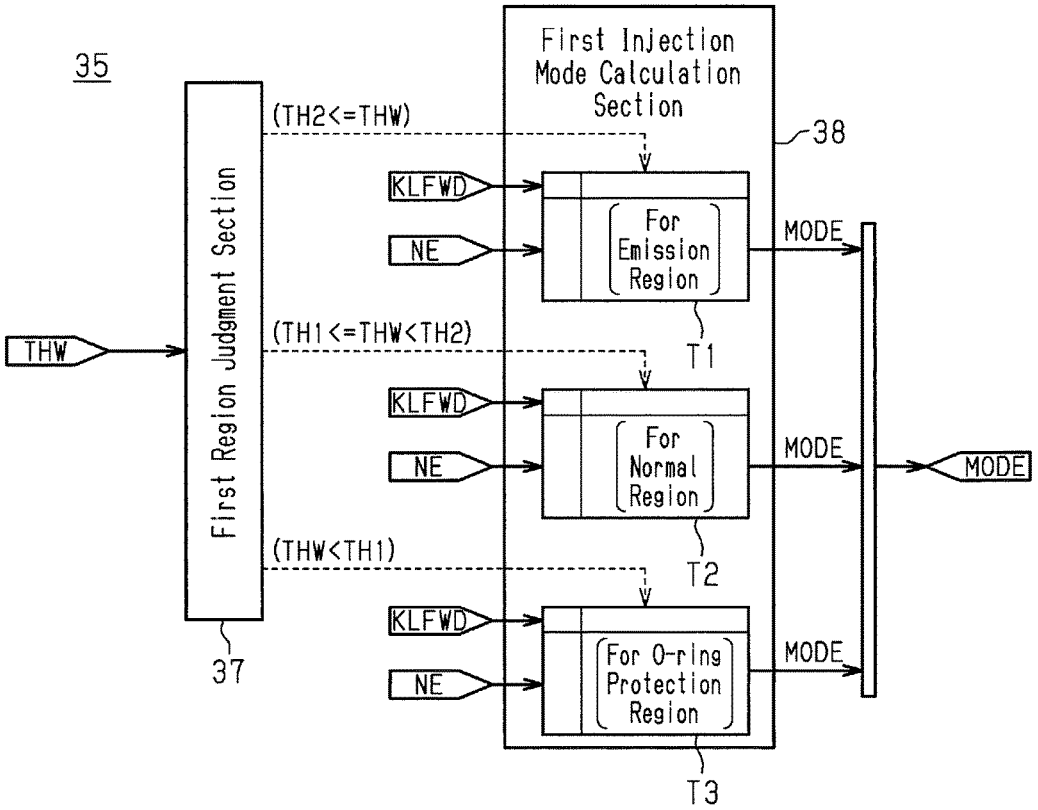
FIG. 5 is a block diagram illustrating the configuration of control of the first injection mode determination section provided in the fuel injection control device.

FIG. 5 illustrates the configuration of control inside the first injection mode determination section 35. As illustrated in FIG. 5, the first injection mode determination section 35 includes a first region judgment section 37 and a first injection mode calculation section 38.

The first region judgment section 37 judges to which one of three coolant temperature regions the current coolant temperature THW belongs. The coolant temperature regions are defined based on the coolant temperature THW and include an O-ring protection region, a normal region, and an emission region. The three coolant temperature regions are described below.

In the internal combustion engine 10, fuel pressure variable control is performed to adjust the pressure of fuel (fuel pressure) supplied to the direct injection valve 26 in accordance with the operation state. O-rings are used as the sealing members in the direct injection valve 26. At cold temperatures, the O-rings may harden, so that the upper limit value of the fuel pressure at which leakage of fuel can be prevented becomes lower than the maximum value of the adjustment range of the fuel pressure in the fuel pressure variable control. For this reason, in the internal combustion engine 10, if the coolant temperature THW is lower than a predetermined temperature TH1, control to protect the O-rings is performed. In the control, the maximum value of the adjustment range of the fuel pressure in the fuel pressure variable control is decreased to such a value that even the O-ring that is hardened due to the cold temperature is capable of preventing leakage of fuel. The O-ring protection region is a coolant temperature region in which such a control to protect the O-rings is executed, that is, a coolant temperature region in which the coolant temperature THW is lower than the above-described temperature TH1.

If the direct-injection-only mode is performed in a state in which the coolant temperature THW is lower than a certain temperature, deterioration of combustion caused by poor vaporization due to adhesion of fuel to the wall surface of the cylinder 12 and the piston 11 is significant. Thus, the combustion performance needs to be increased even if it degrades the emission to some extent. In this specification, the coolant temperature region in which the injection mode is determined with the higher priority in the increase of the combustion performance is defined as the normal region, and the coolant temperature region in which the injection mode is determined with the higher priority in the improvement of the emission is defined as the emission region. More specifically, the normal region is a region in which the coolant temperature THW is higher than or equal to the above-described temperature TH1 and lower than the predetermined temperature TH2, and the emission region is a region in which the coolant temperature THW is higher than or equal to the temperature TH2. Refer to FIG. 4.

In this respect, the first injection mode calculation section 38 calculates the injection mode MODE by selecting the table used to calculate the injection mode MODE in accordance with the judgment result of the coolant temperature region from the first region judgment section 37. The table for calculating the injection mode MODE stores values of the injection mode MODE to be executed at each of operating points of the internal combustion engine 10 specified by the engine speed NE and the predicted load rate KLFWD. The first injection mode calculation section 38 includes, as tables for calculating such an injection mode MODE, three tables T1 to T3 for the emission region, the normal region, and the O-ring protection region. The first injection mode calculation section 38 calculates the injection mode MODE by selecting the table for the coolant temperature region judged by the first region judgment section 37 and by obtaining the value of the injection mode MODE that corresponds to the current engine speed NE and the predicted load rate KLFWD on the selected table.

The above-mentioned three tables T1 to T3 have the following characteristics.

The table T1 for the emission region and the table T2 for the normal region are configured such that the direct-injection-only mode is performed in the entire operation region of the internal combustion engine 10. However, in the table T2 for the normal region, the range of the operation region of the internal combustion engine 10 in which the injection mode MODE that performs the direct injection in the first half of the intake stroke is set as the value is broader than that in the table T1 for the emission region. The reason is as follows. At a low coolant temperature at which the fuel is hard to vaporize, the direct injection is preferably performed at an early stage to ensure sufficient time for the injected fuel to be vaporized. However, when the direct injection is performed in the first half of the intake stroke, part of the injected fuel adheres to the top surface of the piston 11. Such fuel causes incomplete combustion and increases the generation amount of HC. Thus, in the emission region, the direct injection in the first half of the intake stroke is avoided to inhibit generation of HC. In contrast, in the normal region, the direct injection is performed in the first half of the intake stroke to ensure sufficient time for fuel to vaporize even it allows generation of HC to some extent.

Furthermore, in the high-load, high-speed operation region of the internal combustion engine 10, although the requested injection amount is increased, the time for injection is decreased. Thus, in the high-load, high-speed operation region, the fuel pressure variable control generally sets the fuel pressure to be high so that a large amount of direct injection is possible in a short time. In this respect, if the O-ring protection control is performed, there may be an operation region in which the fuel of the requested injection amount cannot be completely injected by only the operation in the direct-injection-only mode. Thus, the table T3 for the O-ring protection region is configured to select the distributed injection mode in the high-load, high-speed operation region and to select the direct-injection-only mode in other operation regions.

Figure 6:
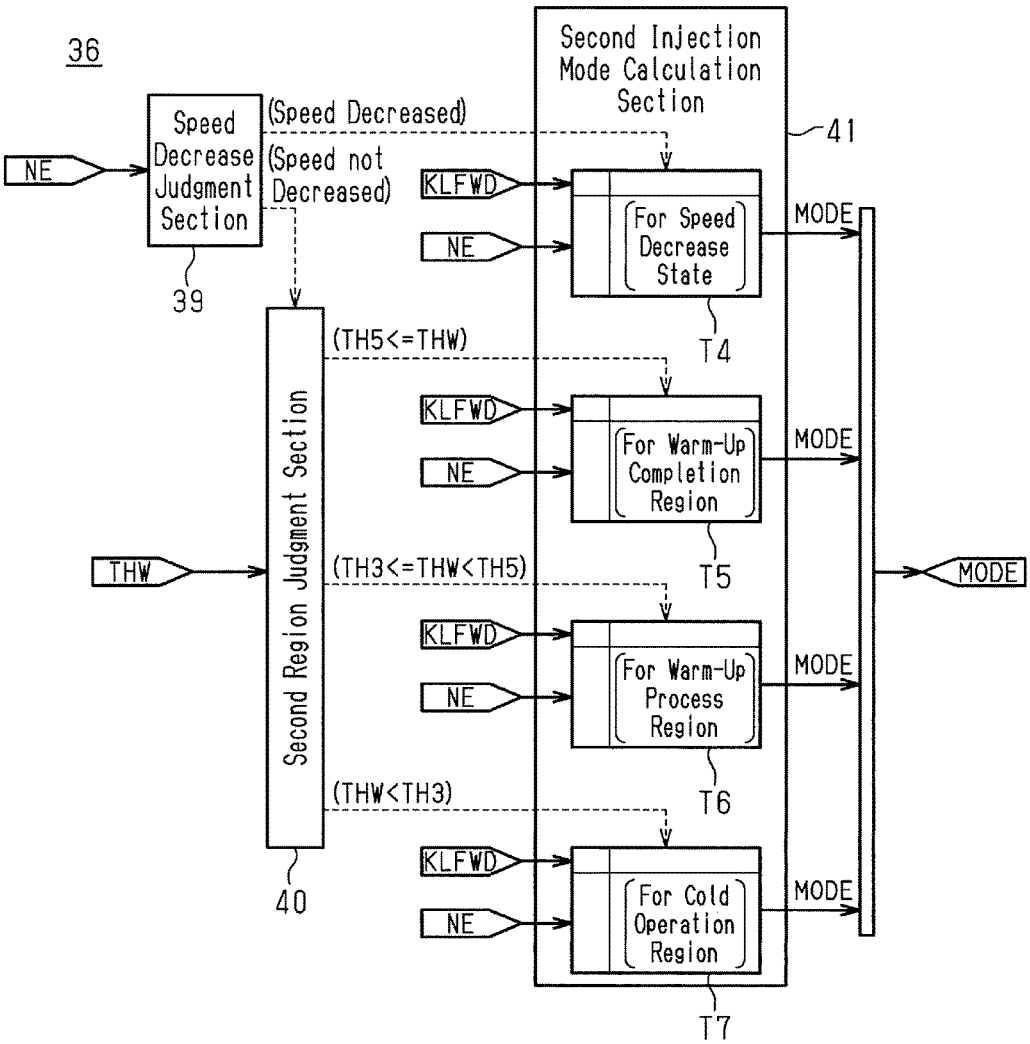
FIG. 6 is a block diagram illustrating the configuration of control of the second injection mode determination section provided in the fuel injection control device.

FIG. 6 illustrates the configuration of control in the second injection mode determination section 36. As illustrated in FIG. 6, the second injection mode determination section 36 includes a speed decrease judgment section 39, a second region judgment section 40, and a second injection mode calculation section 41.

The speed decrease judgment section 39 is configured to judge whether the speed of the internal combustion engine 10 has decreased. In this judgment, if the engine speed NE is lower than the difference obtained by subtracting a predetermined decrease judgment value from the idle speed, it is determined that the speed has decreased. In other cases, it is determined that the speed has not decreased. Such a speed decrease is mainly caused when a less volatile heavy fuel is used as the fuel for the internal combustion engine 10.

The second region judgment section 40 determines the coolant temperature region only in a case in which the speed decrease judgment section 39 has judged that the speed has not decreased. The second region judgment section 40 judges, at this time, to which one of the three coolant temperature regions, which are defined by the coolant temperature THW, the current coolant temperature THW belongs. The coolant temperature regions judged by the second region judgment section 40 are a warm-up completion region, a warm-up process region, and a cold operation region described below. These regions are set based on a different criterion from the O-ring protection region, the normal region, and the emission region described above.

The warm-up completion region is a coolant temperature region higher than or equal to a warm-up complete coolant temperature TH5, which is the coolant temperature THW at which it is determined that the internal combustion engine 10 has been warmed up. The cold operation region is a coolant temperature region lower than a warm-up starting coolant temperature TH3, which is the coolant temperature THW at which it is determined that the internal combustion engine 10 is in a cold operation condition. The warm-up process region is a coolant temperature region in which the coolant temperature THW is higher than or equal to the warm-up starting coolant temperature TH3 and lower than the warm-up complete coolant temperature TH5. The warm-up starting coolant temperature TH3 is a temperature higher than the temperature TH2, which is the coolant temperature THW that divides the above-mentioned normal region and the emission region. Refer to FIG. 4

The second injection mode calculation section 41 is configured to calculate the injection mode MODE by selecting the table to be used for calculation of the injection mode MODE in accordance with the judgment result of the speed decrease judgment section 39 and the second region judgment section 40. The second injection mode calculation section 41 includes, as the table for calculating the injection mode MODE, a table T4 for a speed decrease state that is used when the speed decrease judgment section 39 has determined that the speed has decreased and three tables T5 to T7 for the warm-up completion region, the warm-up process region, and the cold operation region corresponding to the three coolant temperature regions judged by the second region judgment section 40. The second injection mode calculation section 41 is configured to calculate the injection mode MODE by selecting the table corresponding to the judgment result of the speed decrease judgment section 39 and the second region judgment section 40 and by obtaining the value of the injection mode MODE corresponding to the current engine speed NE and the predicted load rate KLFWD on the selected table.

The above-described four tables T4 to T7 have the following characteristics.

As described above, the speed of the internal combustion engine 10 is often decreased during the use of heavy fuel. The injection pressure of fuel in the port injection valve 25 is lower than that in the direct injection valve 26, and the particle diameter of the spray of the injected fuel is large. Thus, if the port injection is performed when heavy fuel is used, poor vaporization is likely to occur. For this reason, the table T4 for the speed decrease state is configured such that, in most of the operation region of the internal combustion engine 10, the direct-injection-only mode in which fuel is easily vaporized even during the use of heavy fuel is selected and, more specifically, the injection mode MODE that performs direct injection in the first half of the intake stroke so that the vaporization time of fuel is increased is selected.

The table T5 for the warm-up completion region is configured such that the injection mode MODE that places a higher priority on the fuel efficiency is executed. The table T5 is configured such that the port-injection-only mode and the distributed injection mode are selected in a broad operation region. Thus, in the table T5, the operation region in which the direct-injection-only mode is selected as the injection mode is narrower than that in the above-described tables T1 to T3, which are used when the port has not been warmed up. The table T5 is configured such that the direct injection in the last half of the compression stroke is executed in the high-load operation region. This is to limit the occurrence of knocking by reducing the temperature in the combustion chamber 16 at the time of ignition with the vaporization heat of the injected fuel. Additionally, in the low-load operation region, the table T5 is configured such that the direct injection in the last half of the intake stroke is performed together with the port injection or the direct injection in the first half of the intake stroke. This is to promote mixing of the previously injected fuel and the intake air by the jet of the direct injection in the last half of the intake stroke so that the air-fuel mixture is made uniform.

In contrast, in the warm-up process region, the wall temperature of the cylinder 12 is not sufficiently increased. This increases the adhesion of fuel to the wall surface of the cylinder 12 in the direct injection. The adhered fuel drops to the oil pan located below the cylinder 12 and advances the fuel dilution of the engine oil. In particular, in the last half of the intake stroke, the piston 11 is lowered, and the area of the wall surface of the cylinder 12 exposed to the combustion chamber 16 is increased. If the direct injection is performed at this timing, the above-described fuel dilution advances more significantly. For this reason, the table T6 for the warm-up process region is configured such that the port-injection-only mode is selected in the operation region broader than that in the table T5 for the warm-up completion region. In the table T6 also, the direct-injection-only mode is set for the high-load operation region. In this case also, the value of the injection mode MODE is a value for performing the direct injection at the timing other than the last half of the intake stroke.

Furthermore, in the cold operation region, the wall temperature of the piston 11 and the cylinder 12 is low. If the direct injection is performed in this state, poor vaporization is likely to occur due to the adhesion of fuel to the wall surface. For this reason, the table T7 for the cold operation region is configured such that the port-injection-only mode in the operation region becomes broader than that in the table T5 for the warm-up completion region. In this respect, the table T7 is the same as the above-described table T6 for the warm-up process region, but differs from the table T6 in the following points. That is, since a higher priority is given to the vaporization of fuel than limiting of the fuel dilution, the direct-injection-only mode in the table T7 is set to perform the direct injection of multiple numbers of times including the direct injection in the last half of the intake stroke.

In the three tables T5 to T7 used by the second injection mode calculation section 41 in the case in which the speed has not decreased, the range of the operation region in which the direct-injection-only mode is selected as the injection mode MODE is narrow compared with any of the three tables T1 to T3 used by the first injection mode calculation section 38 to calculate the injection mode MODE. In the injection mode determination section 32, the injection mode MODE is calculated by the first injection mode calculation section 38 when the port has not been warmed up, and the injection mode MODE is calculated by the second injection mode calculation section 41 when the port has been warmed up. In other words, with the table T4 for the speed decrease state being excluded since the table T4 is not for regular use, the injection mode determination section 32 determines the injection mode MODE so that, when the port has not been warmed up, the range of the operation region in which the direct-injection-only mode is selected as the injection mode MODE is broader than that when the port has been warmed up.

Determination of Basic Injection Starting Time Point

Next, determination of the basic injection starting time point INJT by the basic injection starting time point determination section 33 will be described in detail.

Figure 7:
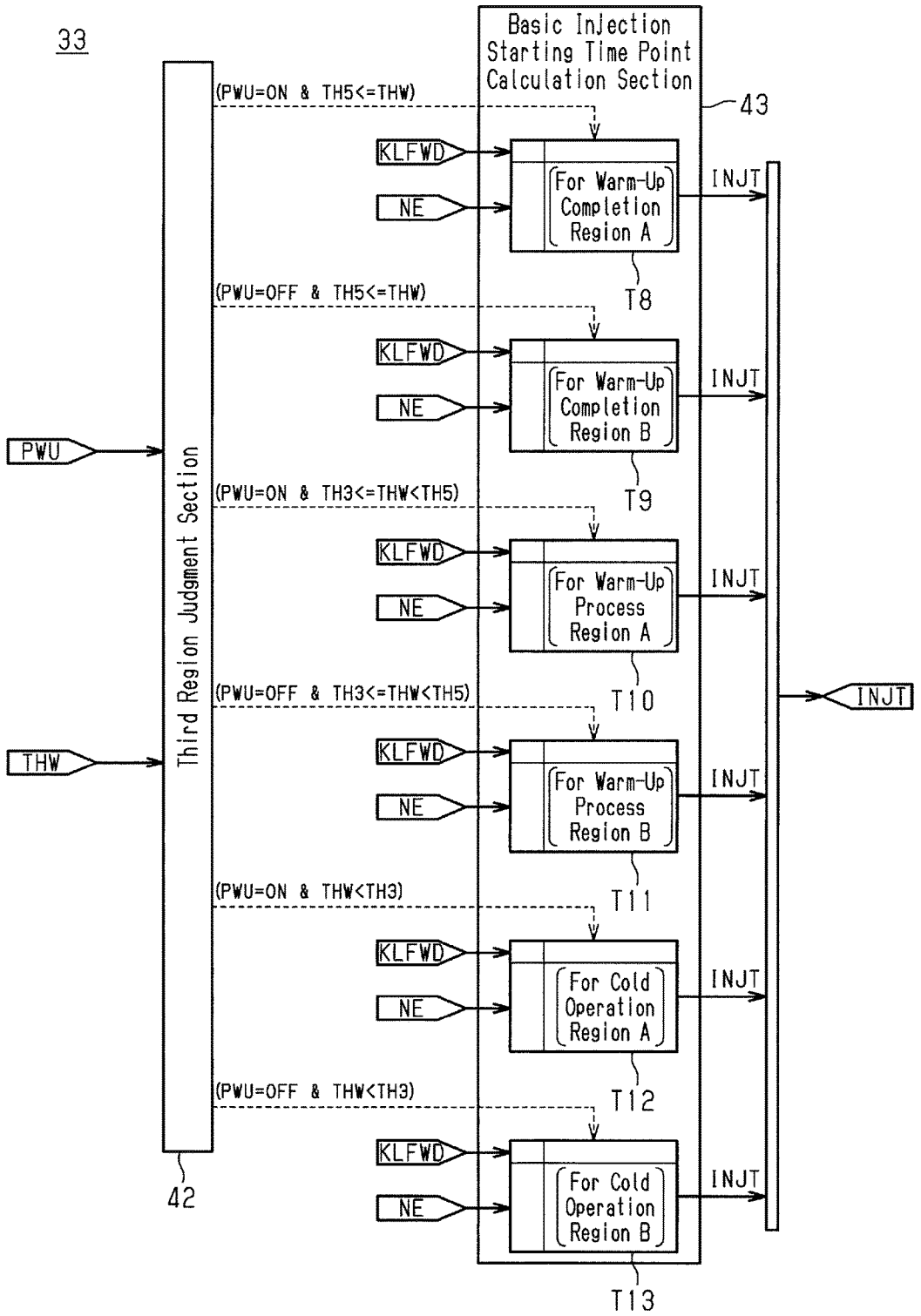
FIG. 7 is a block diagram illustrating the configuration of control of the basic injection starting time point determination section provided in the fuel injection control device.

FIG. 7 illustrates the configuration of control inside the basic injection starting time point determination section 33. As illustrated in FIG. 7, the basic injection starting time point determination section 33 includes a third region judgment section 42 and a basic injection starting time point calculation section 43.

The third region judgment section 42 is configured to judge which of the following six regions is applicable based on the port warm-up completion flag PWU and the coolant temperature THW. The six regions include a warm-up completion region A, a warm-up completion region B, a warm-up process region A, a warm-up process region B, a cold operation region A, and a cold operation region B. The letter A represents that the coolant temperature THW is in the associated coolant temperature region and the port has been warmed up, and the letter B represents that the coolant temperature THW is in the associated coolant temperature region and the port has not been warmed up.

In this respect, the basic injection starting time point calculation section 43 includes six tables T8 to T13 corresponding to the above-described six regions as the tables used to calculate the basic injection starting time point INJT. The basic injection starting time point calculation section 43 is configured to calculate the basic injection starting time point INJT by selecting the table to be used in accordance with the judgment result of the third region judgment section 42. The tables for calculating the basic injection starting time point INJT stores values of the basic injection starting time point INJT for each of the operating points of the internal combustion engine 10 specified by the engine speed NE and the predicted load rate KLFWD.

Such selection of the tables T8 to T13 for calculating the basic injection starting time point INJT is performed to address the problem in each coolant temperature region together with the setting of the injection mode MODE in each coolant temperature region when the port has not been warmed up and when the port has been warmed up as described above. For example, in the cold operation region when the port has been warmed up, fuel is injected by direct injection of multiple numbers of times in the direct-injection-only mode to reduce poor vaporization of fuel. However, the time required to inject fuel for the requested injection amount is undesirably increased by the time corresponding to the intervals of the injection. Thus, the table T12 for the cold operation region A is configured such that the basic injection starting time point INJT is earlier than that in the table T8 for the warm-up completion region A to reduce the delay of the final end of injection timing by starting the injection earlier. Additionally, the above-described emission region when the port has not been warmed up extends over all the warm-up completion region, the warm-up process region, and the cold operation region when the port has been warmed up. Thus, the operation state of the internal combustion engine 10 is significantly changed even in the emission region. The basic injection starting time point INJT is changed even in the same injection mode MODE so that it is possible to cope with changes in the operation state.

The above-described fuel injection control device 30 achieves the following advantages.

(1) According to the present embodiment, if the port warm-up judgment section 31 has judged that the port has not been warmed up in the cold operation of the internal combustion engine 10, the range of the operation region in which the direct-injection-only mode is selected as the injection mode MODE is set to be broader than that when the port warm-up judgment section 31 has judged that the port has been warmed up. Thus, if the port has been warmed up in the cold operation, the operation region in which the port-injection-only mode and the distributed injection mode are selected is increased to avoid poor vaporization caused when the direct injection is performed in the cold operation. However, if the wall surface of the intake port 17 is cold and performing the port injection, on the contrary, causes poor vaporization, execution of the port injection is limited. Thus, the present embodiment inhibits deterioration of combustion in the cold operation of the internal combustion engine 10.

(2) The port warm-up judgment section 31 of the present embodiment judges that the port has been warmed up on condition that the accumulated air amount ΣQ after the startup of the internal combustion engine 10 is initiated is greater than or equal to the port warm-up judgment value DPW, which is set to a value that is increased as the startup coolant temperature is decreased. Such a judgment is performed regardless of changes in the coolant temperature THW after the startup of the internal combustion engine 10 is initiated. Thus, the fuel injection control according to the warm-up state of the intake port 17 is performed independently of the fuel injection control according to the wall temperature of the cylinder 12 based on the coolant temperature THW.

(3) In general, when the engine speed NE is low, the pressure in the intake port 17 is high. If the port injection is performed in this state, poor vaporization of fuel is likely to occur. Thus, if it is judged that the port has been warmed up when the engine speed NE is low, and the port injection is started in the operation region in which the port injection has not been performed, the possibility that the poor vaporization of fuel occurs and the combustion deteriorates is increased. In this respect, the port warm-up judgment section 31 of the present embodiment judges whether the port has been warmed up on condition that the engine speed NE is higher than or equal to the predetermined value α. This inhibits deterioration of combustion in the above-described manner.

(4) The coolant temperature region for selecting the table used for calculation of the injection mode MODE is separately set for the case in which the port has been warmed up and the case in which the port has not been warmed up. Thus, the injection mode is selected in a manner suitable for the circumstances in the case in which the port has been warmed up and the case in which the port has not been warmed up.

The above-described embodiment may be modified as follows.

The condition in which the poor vaporization occurs differs depending on the model of the internal combustion engine. Thus, the setting of the injection mode MODE in each table also differs depending on the models. Additionally, in regard to the number of the coolant temperature regions for each of the case in which the port has been warmed up and the case in which the port has not been warmed up and the range of the coolant temperature THW of each region, suitable values also differ depending on the model. Thus, these values may be changed as required in accordance with the models of the internal combustion engine to which the present invention is applied.

In the above-described embodiment, the accumulated value of the intake air amount GA (accumulated air amount ΣQ) after the startup of the internal combustion engine 10 is initiated is used to judge whether the port has been warmed up. Likewise, the accumulated value of the fuel injection amount after initiation of the startup is a value that correlates to the total amount of heat generated by the combustion after the startup of the internal combustion engine 10 is initiated. Thus, the accumulated value of the fuel injection amount after the startup of the internal combustion engine 10 is initiated may also be used instead of the accumulated air amount ΣQ.

In the above-described embodiment, it is determined that the port has been warmed up on condition that the engine speed NE is higher than or equal to the predetermined value α. As described above, this condition means that the pressure in the intake port 17 is low and can be substituted by the detection value or the estimated value of the intake pressure. In other words, the judgment of step S130 in the port warm-up judgment routine of FIG. 3 may be substituted by a process for judging whether the intake pressure is lower than or equal to a predetermined value.

The judgment of step S130 in the port warm-up judgment routine of FIG. 3 is for suspending the judgment as to whether the port has been warmed up until the vaporization of the injected fuel in the port injection becomes sufficient. The actual judgment as to whether the port has been warmed up is performed in step S120. Thus, if it is only required to simply judge whether the port has been warmed up, the determination in step S130 may be omitted.

In the above-described embodiment, the injection mode is selected among the port-injection-only mode, the direct-injection-only mode, and the distributed injection mode. However, the distributed injection does not necessarily have to be performed, and the injection mode may be selected between the port-injection-only mode and the direct-injection-only mode.

The fuel injection control device 30 does not necessarily have to include the central processing unit and the memory to perform all the above-described various processes with software. For example, the fuel injection control device 30 may include dedicated hardware (application specific accumulated circuit: ASIC) that executes at least some of the processes. That is, the fuel injection control device 30 may include: 1) one or more dedicated hardware circuits such as the ASIC; 2) one or more processors (microcomputers) that operate in accordance with computer programs (software); or 3) circuitry including the combination of the dedicated hardware circuits and the processors.

The invention claimed is:

1. A fuel injection control device for an internal combustion engine configured to be applied to an internal combustion engine including two types of injection valves including a port injection valve, which injects fuel into an intake port, and a direct injection valve, which injects fuel into a cylinder, wherein the fuel injection control device switches an injection mode between a port-injection-only mode, in which only the port injection valve of the two types of injection valves performs fuel injection, and a direct-injection-only mode, in which only the direct injection valve of the two types of injection valves performs fuel injection, a state in which a wall temperature of the intake port is higher than or equal to a predetermined wall temperature is defined as a state in which the port has been warmed up, the fuel injection control device comprises:

a port warm-up judgment section, which is configured to judge whether the port has been warmed up; and an injection mode determination section, which is configured to determine the injection mode to be executed by the internal combustion engine based on an engine speed and an engine load, the injection mode determination section is configured such that, when determining the injection mode in a cold operation, in which a coolant temperature of the internal combustion engine is lower than or equal to a predetermined coolant temperature, the injection mode determination section sets, in an operation region of the internal combustion engine specified by the engine speed and the engine load, a range of the operation region in which the direct-injection-only mode is selected as the injection mode to be broader in a case in which the port warm-up judgment section has judged that the port has not been warmed up than in a case in which the port warm-up judgment section has judged that the port has been warmed up, and wherein the port warm-up judgment section is configured to set a port warm-up judgment value as a value that is increased as the coolant temperature at a time when the startup of the internal combustion engine is initiated is decreased and is configured to judge that the intake port has been warmed up when an accumulated value of an intake air amount or a fuel injection amount after the startup of the internal combustion engine is initiated is greater than or equal to the port warm-up judgment value, regardless of any changes in the coolant temperature after the startup of the internal combustion engine.

2. The fuel injection control device according to claim 1, wherein the port warm-up judgment section is configured to judge that the intake port has been warmed up based on the additional condition that the engine speed is higher than or equal to a predetermined value.

3. A fuel injection control method applied to an internal combustion engine including two types of injection valves including a port injection valve, which injects fuel into an intake port, and a direct injection valve, which injects fuel into a cylinder, wherein the fuel injection control method includes switching an injection mode between a port-injection-only mode, in which only the port injection valve of the two types of injection valves performs fuel injection, and a direct-injection-only mode, in which only the direct injection valve of the two types of injection valves performs fuel injection, and a state in which a wall temperature of the intake port is higher than or equal to a predetermined wall temperature is defined as a state in which the port has been warmed up, the fuel injection control method comprising:

judging whether the port has been warmed up;

determining the injection mode to be executed by the internal combustion engine based on an engine speed and an engine load;

when determining the injection mode in a cold operation, in which a coolant temperature of the internal combustion engine is lower than or equal to a predetermined coolant temperature, setting, in an operation region of the internal combustion engine specified by the engine speed and the engine load, a range of the operation region in which the direct-injection-only mode is selected as the injection mode to be broader in a case in which it is judged that the port has not been warmed up than in a case in which it is judged that the port has been warmed up; and setting a port warm-up judgment value as a value that is increased as the coolant temperature at a time when the startup of the internal combustion engine is initiated is decreased, wherein judging whether the intake port has been warmed up includes judging that the intake port has been warmed up when an accumulated value of an intake air amount or a fuel injection amount after the startup of the internal combustion engine is initiated is greater than or equal to the port warm-up judgment value, regardless of any changes in the coolant temperature after the startup of the internal combustion engine.

4. A fuel injection control device for an internal combustion engine configured to be applied to an internal combustion engine including two types of injection valves including a port injection valve, which injects fuel into an intake port, and a direct injection valve, which injects fuel into a cylinder, the fuel injection control device comprising circuitry, wherein the circuitry is configured to switch an injection mode between a port-injection-only mode, in which only the port injection valve of the two types of injection valves performs fuel injection, and a direct-injection-only mode, in which only the direct injection valve of the two types of injection valves performs fuel injection, a state in which a wall temperature of the intake port is higher than or equal to a predetermined wall temperature is defined as a state in which the port has been warmed up, the circuitry is configured to perform judging whether the port has been warmed up, determining the injection mode to be executed by the internal combustion engine based on an engine speed and an engine load, and when determining the injection mode in a cold operation, in which a coolant temperature of the internal combustion engine is lower than or equal to a predetermined coolant temperature, setting, in an operation region of the internal combustion engine specified by the engine speed and the engine load, a range of the operation region in which the direct-injection-only mode is selected as the injection mode to be broader in a case in which it is judged that the port has not been warmed up than in a case in which it is judged that the port has been warmed up; and setting a port warm-up judgment value as a value that is increased as the coolant temperature at a time when the startup of the internal combustion engine is initiated is decreased, wherein judging whether the intake port has been warmed up includes judging that the intake port has been warmed up when an accumulated value of an intake air amount or a fuel injection amount after the startup of the internal combustion engine is initiated is greater than or equal to the port warm-up judgment value, regardless of any changes in the coolant temperature after the startup of the internal combustion engine.

* * * * *